United States Patent [19]

Jacobsen

[11] 4,445,239

[45] May 1, 1984

[54] SUSPENDED SHOWER-TUB DOORS WITH UPPER STABILIZING MEANS

[76] Inventor: Ralph E. Jacobsen, 42 Afton Dr., Florham Park, N.J. 07932

[21] Appl. No.: 410,897

[22] Filed: Aug. 24, 1982

[51] Int. Cl.[3] ..... A47K 3/14; A47H 15/04; E03D 15/06

[52] U.S. Cl. ..... 4/607; 4/610; 49/410

[58] Field of Search ..... 4/607, 559, 557, 608, 4/610, 558, 597, 596, 599, 600, 605, 609, 614; 49/409, 408, 410–411, 428

[56] References Cited

U.S. PATENT DOCUMENTS

| | | | |
|---|---|---|---|
| 3,359,573 | 12/1967 | Casebolt | 4/607 |
| 3,896,508 | 7/1975 | Doan | 4/557 |
| 4,090,265 | 5/1978 | Baus | 4/607 |
| 4,358,863 | 11/1982 | Jacobsen | 4/607 |

FOREIGN PATENT DOCUMENTS

| | | | |
|---|---|---|---|
| 2314444 | 10/1974 | Fed. Rep. of Germany | 4/607 |
| 2943122 | 5/1981 | Fed. Rep. of Germany | 4/607 |

*Primary Examiner*—Henry K. Artis
*Attorney, Agent, or Firm*—Harvey B. Jacobson

[57] ABSTRACT

An upper horizontal rail structure is stationarily supported in elevated position above the upper marginal edge of the outer wall of the lower tub portion of a shower-tub area and defines three laterally spaced depending inner, outer and intermediate flange portions between which inner and outward downwardly opening channels are formed. A pair of upstanding inner and outer shower doors are provided including upper marginal edge portions slidably received in the corresponding channels and each upper marginal edge includes a pair of opposite end support rollers rollingly engaged with longitudinally extending track structure in the corresponding channel. In addition, the upper marginal edge portion of each door includes opposite end inner and outer guide roller structure journalled therefrom about upstanding axes and projecting outwardly from at least the inner and outer sides, respectively, of the door upper marginal edge portion below the support rollers thereof and above the lower marginal edges of the corresponding flange portions. The guide rollers are disposed for rolling engagement with the opposing surfaces of the corresponding flange portions and adjustably mounted from the corresponding doors for shifting laterally thereof. The lower marginal edges of the doors are disposed adjacent to the upper marginal edge of the outer wall of the associated tub portion and are free of guided engagement therewith.

7 Claims, 3 Drawing Figures

SUSPENDED SHOWER-TUB DOORS WITH UPPER STABILIZING MEANS

BACKGROUND OF THE INVENTION

Various forms of shower door support and guiding structures heretofor have been provided for enclosing a tub-shower enclosure and wherein the doors may be moved between open and closed positions closing the area of the enclosure disposed in vertical registry with and above the upper marginal edge of the outer wall of the associated tub. However, most of these guiding structures require the utilization of a coacting guide portions carried by the upper marginal edge of the outer wall of the associated tub portion and the lower marginal edges of the shower doors. This coacting guide structure usually incorporates a lower guide track supported from the tub upper marginal wall portion and rollers or other guide structures carried by the lower marginal edges of the associated doors. The utilization of such tracks along the upper marginal edge of the tub outer wall creates a cleaning problem and also distracts from the aesthetics of the tub-shower enclosure. Accordingly, a need exists for a tub-shower enclosure door assembly which does not require the utilization of a guide track supported from the upper marginal edge of the outer tub wall. Such a structure is disclosed in my copending U.S. application Ser. No. 97,732, filed Nov. 26, 1979, for Shower Enclosure, now U.S. Pat. No. 4,358,863, dated Nov. 16, 1982. In addition, there are other forms of doors for tub-shower enclosures and similar structures are disclosed in U.S. Pat. Nos. 1,332,989, 3,074,077, 3,188,699, 3,359,573, 3,783,456, and 4,090,265 as well as French patent Nos. 1,017,762 and 1,186,714.

BRIEF DESCRIPTION OF THE INVENTION

The tub-shower enclosure door assembly of the instant invention utilizes only a pair of shower doors and an upper horizontal rail structure provided for stationary support in elevated position spaced above the upper marginal edge of the outer wall of a tub. The doors and tub are free of a coacting structure which guidingly support the lower marginal edges of the doors from the outer wall of the tub and the upper marginal edges of the doors and the rail structure include coacting support structure in the form of tracks carried by the rail structure and support roller means carried by the doors which rollingly support the upper marginal edges of the doors from the rail structure. In addition, the opposite ends of the upper marginal edges of the doors include inner and outer rollers journaled from the doors about upstanding axes and which project outwardly from at least the inner and outer sides, respectively, of the door upper marginal edge portions. The guide rollers rollingly engage the opposing surfaces of the corresponding flange portions at an elevation space slightly above the lower marginal edges of the flange portion and appreciably below the support roller structure by which the doors are suspended from the rail structure. Further, the guide rollers are adjustable laterally of the doors whereby substantially all clearance between the guide rollers and the opposing flange portions surfaces may be eliminated and the rail structure may affect a positive guide on the doors during and intermediate periods of movement thereof along the rail structure against lateral deflection of the lower marginal edges of the doors.

The main object of this invention is to provide a tub-shower area door enclosure assembly which may be readily retrofitted to existing tub-shower areas and which includes a pair of generally conventional horizontally sliding doors suspended and guidingly supported only from an upper support channel structure stationarily matted in elevated position above the upper marginal edge of the outer wall of the associated tub.

Another object of this invention is to provide a door enclosure assembly which may be mounted from a drop ceiling portion or which may be mounted only at the opposite ends of the support channel structure thereof from opposing wall surfaces spaced below a ceiling structure.

Still another object of this invention is to provide a door enclosure assembly in accordance with the preceding objects and including structural features thereof which facilitate ready initial mounting and subsequent at least partial disassembly for maintenance or repair.

The final object of this invention to be specifically enumerated herein is to provide a door enclosure assembly in accordance with the preceding objects and which will conform to the conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
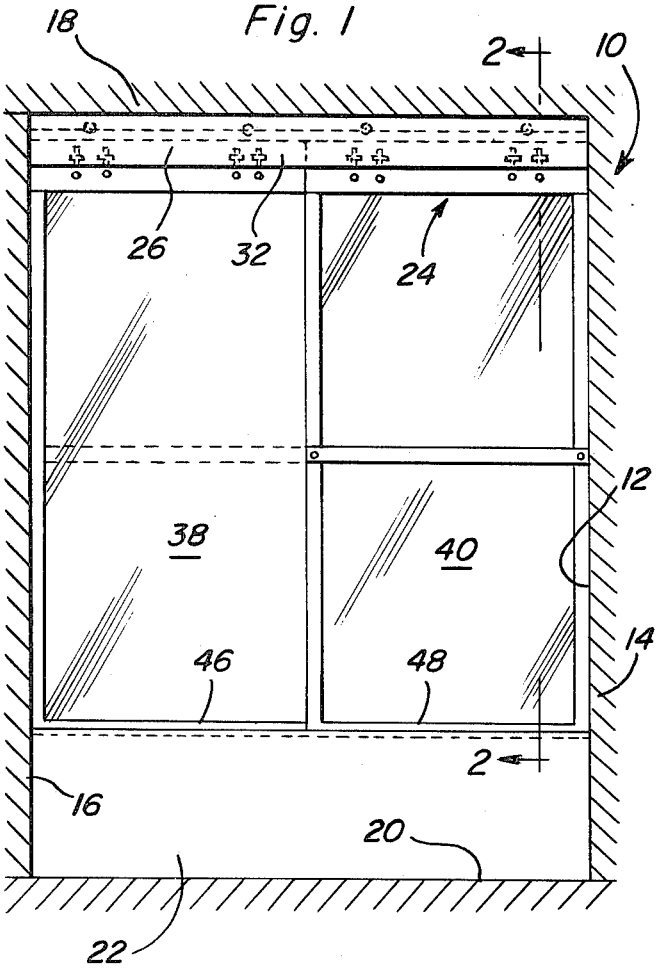
FIG. 1 is an elevational view of a tub-shower assembly equipped with the door enclosure assembly of the incident invention and as seen from outwardly of the front side of the tub with the doors of the door assembly in closed position.

Referring now more specifically to the drawings the numeral 10 generally designates a building structure defining a combined tub and shower area 12 extending between a pair of end walls 14 and 16 and an upper wall or ceiling 18 and a floor 20. A conventional tub 22 rests upon the floor 20 between the end walls 14 and 16 as is conventional.

Figure 2:
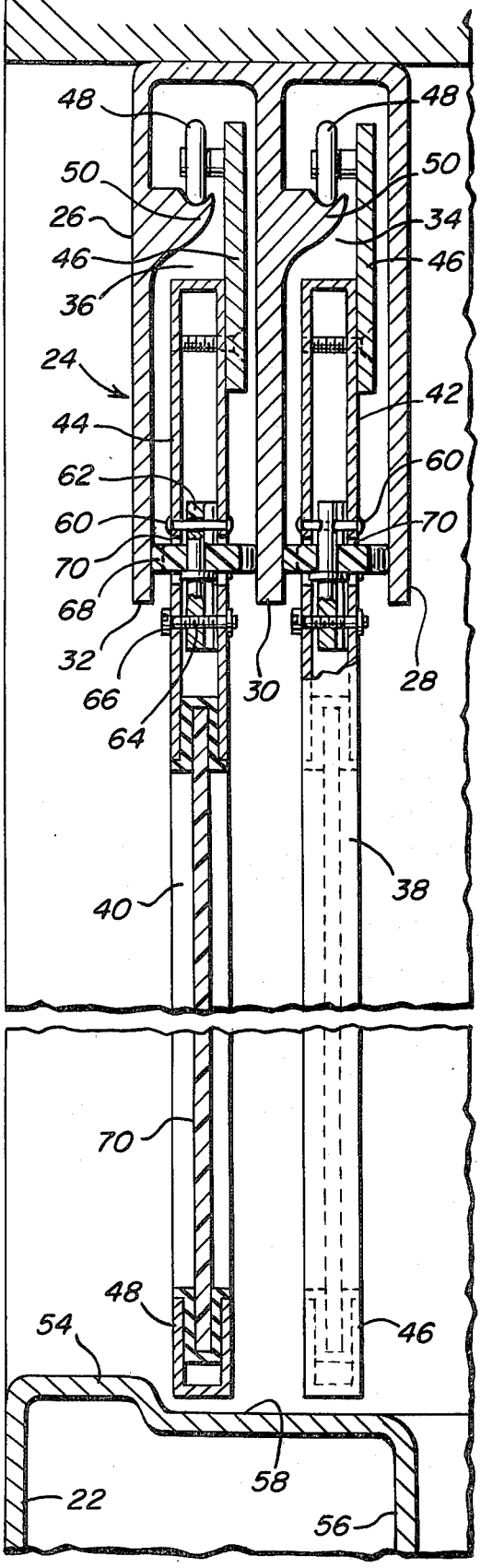
FIG. 2 is an enlarged fragmentary vertical sectional view taken substantially upon the plane indicated by the section line 2—2 of FIG. 1.
Figure 3:
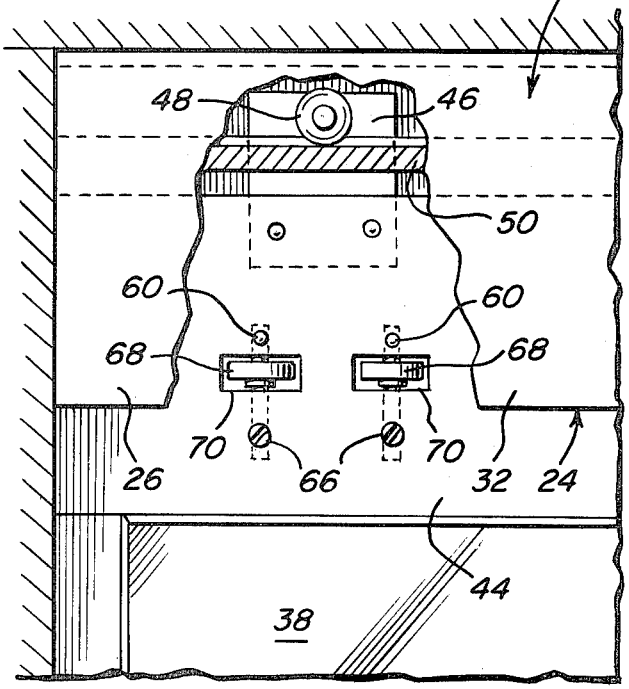
FIG. 3 is an enlarged fragmentary elevational view of the upper left hand portion of FIG. 1 with portions of the corresponding door and channel structure being broken away and illustrated in vertical section.

The shower enclosure structure of the instant invention is referred into in general by the reference numeral 24 and includes the upper horizontal rail structure 26 secured to the ceiling 18 in any conventional manner and extending between the end walls 14 and 16. The rail structure 26 includes inner, intermediate and outer depending flanges 28, 30 and 32 defining a pair and outer dowwardly opening channels 34 and 36 therebetween. The enclosure structure 24 also includes a pair of inner and outer shower doors 38 and 40 including upper marginal edge portions 42 and 44 as well as lower marginal edge portions 46 and 48. Each of the shower doors 38 and 40 includes opposite end upwardly projecting mounting plates 46 supported therefrom and each mounting plate 46 journals a support wheel 48 from an upper portion thereof. The pairs of opposite end support wheels 48 are rollingly engaged with longitudinally extended tracks or rail structures 50 comprising a part of the rail structure 26 and disposed in the upper portions of the channels 34 and 36. Accordingly, it may be seen that the upper marginal edge portions 42 and 44 of the doors 38 and 40 are suspended within the channels and 34 and 36 by the rollers 48 and the rails or tracks 50 for bypassing movement of the doors 38 and 40 between the end walls 14 and 16. Further, it will be noted from FIG. 2 of the drawings that the rail structure 26 is disposed in vertical registry with the upper marginal edge portion 54 of the outer wall 56 of the tub 22.

If it is desired, the upper marginal edge 54 of the outer walls 56 may have an inner edge recess 58 formed therein to prevent splashing water from flowing outwardly of the wall 56 over the upper marginal edge 54 thereof and with which recess 58 the lower marginal edges 46 and 48 of the doors 38 and 40 may be registered. Alternately, if the upper marginal edge 54 of the wall 56 is not provided with a recess such as the recess 58, a separate splash guard (not shown) such as that disclosed at 100 in my above noted copending application may be used.

Each upper marginal edge portion 42 and 44 includes a transverse suspension pin 60 secured therethrough slidably supporting the upper end of a diametrically bored vertical axle pin therefrom. In addition, the lower end of each axle pin 62 includes a threaded diametric bore 64 through which a threaded adjustment screw 66 is threadingly received, each adjustment screw 66 being journaled through the corresponding upper marginal edge portion 42. Each axle pin 62 rotatably journals a guide roller 68 therefrom and diametrically opposite portions of the guide rollers 68 project outwardly vbeyond the opposite ends of transverse openings 70 formed through the lower portions of the upper marginal edge portions 42 and 44.

Each door 38 and 40 includes a pair of inner and outer rollers 68 at each of its opposite ends. Each roller 68 may be adjusted to project either further outwardly of the inner or outer side of the corresponding door and one roller at each end of each door projects further outwardly of the inner side of the corresponding door while the other roller projects further outwardly of the outer side of that door. The opposite peripheral portions of the inner and outer rollers carried by each door 38 and 40 are disposed for rolling contact with the opposing surfaces of the corresponding flanges. Thus, the outer rollers 68 of the door 40 are rollingly engaged with the inner surfaces of the outer flange 32 while the inner rollers of the door 40 are rollingly engaged with the outer surface of the flange 30. It then follows that the outer rollers 68 of the door 38 are rollingly engaged with the inner surface of the flange 30 and the inner rollers 68 of the door 38 are rollingly engaged with the outer surface of the inner flange 28.

It will be noted that the tracks or rails 50 are defined in upper portions of the channels 34 and 36 and that the rollers 68 are received in lower portions of the channels 34 and 36. Accordingly, the doors 38 and 40 are supported from the rail structure 26 against lateral deflection of the lower marginal edges 46 and 48 of the doors 38 and 40.

If it is desired, the rail structure 26 may be mounted between the walls 14 and 16 at an elevation spaced below the ceiling 18 and if this method of mounting the rail structure 26 is utilized, the opposite ends of the rail structure 26 could be mounted from the end walls 14 and 16 for frictionally resisted angular displacement about a longitudinal axis disposed generally midway between the rails or track 50. In addition, the opposite end vertical members of the doors 38 and 40 may extend upward into the upper marginal edge portions 42 and 44 of the doors 38 and 40, which doors may include either fiberglass or glass panels 70.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A shower enclosure structure for the ingress and egress zone for and from a tub-shower area and disposed above the marginal edge of the outer wall of the lower tub portion of said area, said enclosure structure including an upper horizontal rail structure for stationary support in elevated positions spaced above said upper marginal edge, said rail structure defining depending laterally spaced inner, outer and intermediate flange portions with inner and outer downwardly opening channels defined between the inner side of the intermediate flange portion and the outer side of the inner flange portion and between the outer side of the intermediate flange portion and the inner side of the outer flange portion, the upper portions of said inner and outer flange portion, the upper portions of said inner and outer channels including upwardly facing inner and outer track means therein spaced appreciably above the lower marginal edges of said flange portions, a pair of upstanding inner and outer sliding doors having upper marginal edge portions slidingly received within said inner and outer channels and equipped with opposite end support roller means rollingly engaged with the corresponding track means at points spaced longitudinally there along for suspended support of said inner and outer doors from said inner and outer track means, the opposite ends of the upper marginal edge portion of each of said doors including inner and outer guide roller means journaled therefrom about upstanding axes and projecting outwardly from at least the inner and outer sides, respectively, of the upper marginal edge portion of the corresponding door below the corresponding support rollers and above the lower marginal edges of the corresponding flange portions, said inner and outer guide roller means of said inner door being disposed for guiding rolling contact with the outer and inner surfaces of said inner and intermediate flanges, respectively, and the inner and outer guide roller means of said outer door being disposed for guiding rolling contact with the outer and inner surfaces of said intermediate and outer flanges, respectively, said doors including lower marginal edge portion free of guide roller means for guiding engagement with a stationary guide structure.

2. The shower enclosure of claim 1 wherein at least the inner roller means includes means operative to laterally shift the axes of rotation thereof laterally of the corresponding door.

3. The enclosure structure of claim 1 wherein at least the outer roller means includes means operative to laterally shift the axes of rotation thereof laterally of the corresponding door.

4. The enclosure structure of claim 1 wherein each roller means includes means operative to laterally shift the axis of rotation thereof laterally of the corresponding door.

5. The enclosure structure of claim 1 wherein each of said guide roller means includes a vertically disposed axle pin having a roller journaled thereon, each of said axle pins being supported from the corresponding door upper marginal edge portion for lateral shifting of the pin transversely of the corresponding door.

6. The enclosure structure of claim 5 wherein each of said axle pins includes a diametric bore formed through the upper end thereof through which a stationary transverse support pin supported from the corresponding door is slidingly received, the lower end of each axle pin having a threaded bore formed there through, each of said doors including a threaded adjustment screw extending transversely thereof journaled from the corresponding door and threadedly received through the corresponding threaded bore.

7. The combination of claim 6 wherein said door upper marginal edge portions have openings formed therethrough through which the rollers of the corresponding guide roller means project.

* * * * *